US007274278B2

(12) United States Patent
Weller et al.

(10) Patent No.: US 7,274,278 B2
(45) Date of Patent: Sep. 25, 2007

(54) TUNABLE MICRO ELECTROMECHANICAL INDUCTOR

(75) Inventors: Thomas Weller, Lutz, FL (US); Balaji Lakshminarayanan, Tampa, FL (US); Srinath Balachandran, Tampa, FL (US)

(73) Assignee: University of South Florida, Tampa, FL (US)

( * ) Notice: Subject to any disclaimer, the term of this patent is extended or adjusted under 35 U.S.C. 154(b) by 0 days.

(21) Appl. No.: 11/162,421

(22) Filed: Sep. 9, 2005

(65) Prior Publication Data

US 2006/0290450 A1 Dec. 28, 2006

Related U.S. Application Data

(60) Provisional application No. 60/522,275, filed on Sep. 9, 2004.

(51) Int. Cl.
*H01P 1/10* (2006.01)
*H01P 3/08* (2006.01)

(52) U.S. Cl. ..... 333/262; 333/105

(58) Field of Classification Search ..... 333/105, 333/262, 101; 200/181
See application file for complete search history.

(56) References Cited

OTHER PUBLICATIONS

Balachandran et al., MEMS Tunable Planar Inductors Using DC-Contact Switches, Oct. 2004, 34th European Microwave Conference, 713-716.*

J.M. Deii et al. Variable MEMS-Based Inductors Fabricated From Pecvd Silicon Nitride, 2002 pp. 567-570.

Xi-Nig Wang et al., Fabrication and Performance of a Novel Suspended Rf Spinal Inductor, IEEE Transactions on Electron Devices, May 2004, pp. 814-816, vol. 51, No. 5.

N.Sarkar et al., Microassembled Tunable MEMS Inductor, 2005, pp. 183-186.

C.M Tassetti et al., Tunable RF MEMS microinductors for future communication systems, 2003, pp. 541-545.

Chia-Ying Lee et al., The Enhanced Q Spiral Inductors with MEMS Technology for RF Applications.

Jean-Baptiste David et al., RF High-Q Spiral Inductor Design, 2001, pp. 78-81.

A.J. Pang et al., Flip Chip Assembly of MEMS Inductors, 2003, pp. 298-300.

I. Zine-El-Abidine et al., A Turnable RF MEMS Inductor, 2004.

Dimitrios Peroulis et al., Tunable Lumped Components with Applications to Reconfigurable MEMS Filters, 2001 pp. 341-344.

Dimitrios Peroulis et al., MEMS Devices For High Isolation Switching And Tunable Filtering, 2000, pp. 1217-1220.

R.R. Mansour et al., RF MEMS Devices, 2003.

* cited by examiner

*Primary Examiner*—Dean Takaoka
(74) *Attorney, Agent, or Firm*—Molly L. Sauter; Smith & Hopen, P.A.

(57) ABSTRACT

The present invention provides a monolithic inductor developed using radio frequency micro electromechanical (RF MEMS) techniques. In a particular embodiment of the present invention, a tunable radio frequency microelectromechanical inductor includes a coplanar waveguide and at least one direct current actuatable contact switch positioned to vary the effective width of a narrow inductive section of the center conductor of the CPW line upon actuation the DC contact switch.

15 Claims, 4 Drawing Sheets

TUNABLE MICRO ELECTROMECHANICAL INDUCTOR

CROSS REFERENCE TO RELATED APPLICATIONS

This application claims priority to U.S. Provisional Patent Application No. 60/522,275, "A Tunable Micro Electromechanical Inductor", filed Sep. 9, 2004.

STATEMENT OF INTEREST

This work has been supported by National Science Foundation grant 2106-301-LO and Raytheon Systems grant 2106-315-LO.

BACKGROUND OF INVENTION

The design of microwave and millimeter wave electronics requires components that provide a capability for impedance matching, and/or tuning. Impedance matching is the process through which signals are made to propagate through a high frequency network with a specific amount of reflection, typically as low as possible.

Two of the most common types of components used for impedance matching are capacitors and inductors. Radio frequency micro electromechanical (RF MEMS) techniques have in the past been used to fabricate state-of-the-art tunable capacitors in a variety of different forms. However, to date much less progress has been made in developing RF MEMS tunable inductors.

Prior art in tunable inductors of the RF MEMS type basically consist of topologies in which RF MEMS switches are used to select between different tuning states. Inductors are integral components in RF front end architectures that include filters, matching networks and tunable circuits such as phase shifters. The most common inductor topologies include planar spirals, aircore, and embedded solenoid designs. In comparison to capacitors, however, relatively few tunable inductor configurations have been published; among those presented, many are hybrid approaches that employ MEMS switches to activate different static inductive sections. Furthermore, less attention has been paid to designs that enable control in the sub-nH range as is potentially desirable for matching purposes in applications that use distributed loading of small capacitances, e.g. in loaded-line phase shifters.

Accordingly what is needed in the art is an improved tunable inductor of the RF MEMS type.

SUMMARY OF INVENTION

The present invention provides a distributed tunable inductor using DC-contact MEMS switches. A high inductance value is realized using a small length of high impedance line, while a low inductance is realized by reconfiguring the same circuit to yield a low impedance line using DC-contact switches.

In accordance with the present invention, a tunable radio frequency microelectromechanical inductor is provided. The tunable inductor includes a coplanar waveguide having a center conductor and two spaced apart ground conductors, the center conductor being positioned between the two spaced apart ground conductors, and the center conductor further including a narrow width inductive section. The RF MEMS inductor further includes at least one direct current actuatable contact switch positioned to vary the effective width of the narrow inductive section of the center conductor upon actuation of the at least one contact switch and a direct current bias line positioned to actuate the at least one actuatable contact switch.

A high inductance value is realized using a small length of high impedance line, which is provided by the narrow width inductive section of the center conductor. In a specific embodiment, this narrow width inductive section is of uniform width over the length of the small length section. In an additional embodiment, the center conductor is a meandered center conductor over the length of the narrow width section, thereby increasing the inductance ratio of the device.

In accordance with the present invention, the actuatable contact switch is in contact at one end with the center conductor and suspended above the coplanar waveguide bordering the narrow inductive section of the center conductor, such that upon actuation, the contact switch increases the effective width of the narrow inductive section, which in turn narrows the slot width between the center conductor and the ground conductor, resulting in a lower inductance value along the transmission line. Alternatively, the actuatable contact switch may be positioned on either or both of the ground conductors of the coplanar waveguide.

In a specific embodiment, the actuatable contact switch of the tunable inductor is a cantilever beam. The cantilever beam is positioned with one end in contact with the wider portion of the center conductor at one end of the narrow width section through a standoff post and then suspended over the length of the narrow width section with the other end of the cantilever positioned to make contact with the wider portion of the center conductor at the opposite end of the narrow section. Upon application of the DC bias to the DC bias line positioned below the cantilever beam, the cantilever beam is actuated, thereby bridging across the narrow section of the center conductor and increasing the effective width of the narrow section.

While many dimensions of the tunable RF MEMS inductor are within the scope of the present invention, in a particular embodiment, the cantilever beam has a width of approximately 50 μm and the narrow width section of the center conductor is approximately 600 μm.

To provide the DC bias to actuate the switches, a SiCr bias line passes through a cut made in the ground plane of the ground conductors and under the actuatable switch. To reestablish the connectivity between the two split sections of the ground conductors resulting from the cut, a thin wire-bond or an air-bridge is provided.

In a particular embodiment, a plurality of direct current actuatable contact switches are provided and in a preferred embodiment an actuatable contact switch is positioned on each side of the narrow width inductive section of the center conductor.

In accordance with the present invention is provided, a tunable RF MEMS inductor in which the tuning functionality is directly integrated into the inductor itself. The resulting inductor is compact in size, provides very fine resolution in its tuning states, and can be applied in a variety of different circuit applications. These applications include, but are not limited to, true-time-delay phase shifters, impedance matching networks for amplifiers, and tuning networks for couplers and filters.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
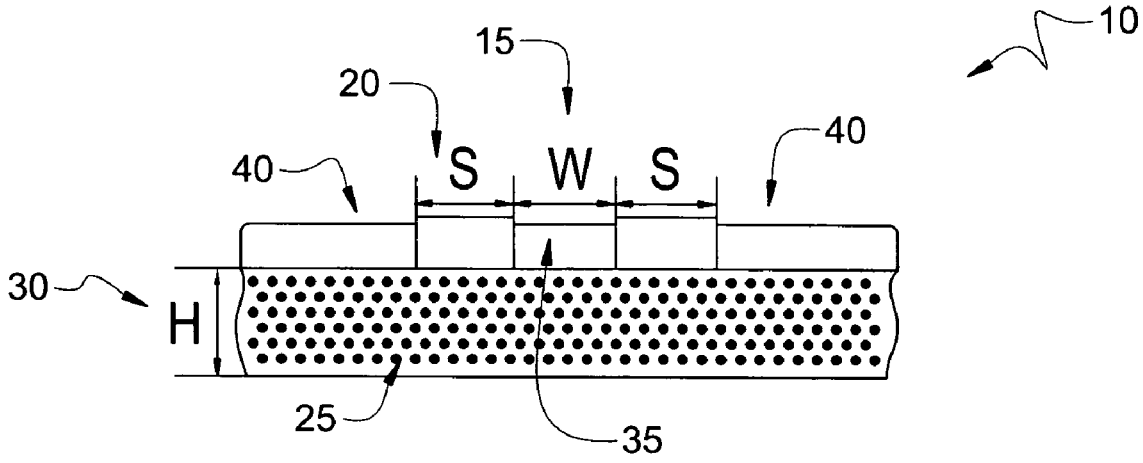
FIG. 1 (Prior Art)
FIG. 1 is a schematic illustration of the cross-section of a coplanar waveguide as known in the prior art.

Coplanar waveguide (CPW) transmission lines are known in the art. With reference to FIG. 1, a CPW transmission line 10 consists of a center conductor 35 positioned between two ground conductors 40. The physical parameters that affect the impedance of a CPW transmission line 10 are the conductor width (W) 15, slot width (S) 20, dielectric constant of the substrate ($\in_T$) 25, and the thickness (H) of the substrate 30. For a given dielectric constant 25 and the substrate thickness 30, a narrow width center conductor and a wide slot width result in high impedance. On the contrary, wide center conductor and a narrow slot width results in low impedance.

Figure 2:
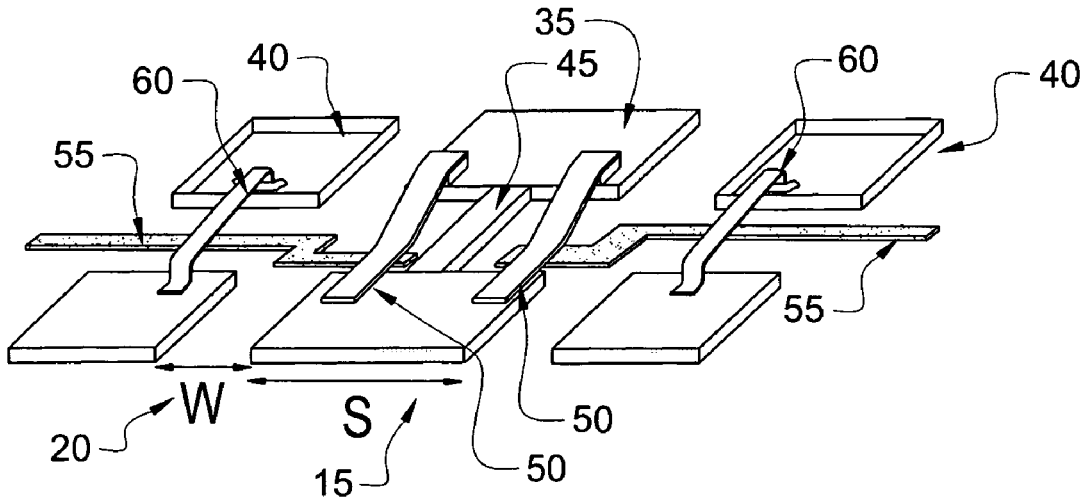
FIG. 2 is three-dimensional diagrammatic view of an embodiment of the tunable radio frequency microelectromechanical inductor in accordance with the present invention having cantilever beams positioned on the center conductor of the transmission line.

With reference to FIG. 2, in accordance with the present invention, a short length 35 of high impedance CPW transmission line is designed to emulate an inductor. In a particular embodiment, the short length 35 is approximately less than or equal to one quarter-wavelength $\lambda/4$. As such, in accordance with the present invention a digital type tuning of the transmission line inductor is made possible by changing the effective width 15 of the center conductor 35 and the slot width 20 using DC-contact switches 50.

In a first embodiment, a tunable inductor with DC-contact switches 50 on the center conductor 35 of a CPW transmission line 10 is described. With reference to FIG. 2 is shown an illustrative view of the tunable inductor in accordance with the present invention. The DC-contact switches 50 are located on the center conductor 35 and suspended above the CPW structure 10. In a particular embodiment, the switches 50 are suspended approximately 2 μm above the CPW structure 10. When the switches 50 are in the non-actuated state, the effective impedance of the microelectromechanical (MEM) section is high (narrow W and wide S), thereby resulting in a high inductance. Furthermore, when the switches 50 are actuated, the effective impedance of the MEM section is low (wide W and narrow S) thereby providing a low inductance. In this embodiment the width of the narrow section 45 of the center conductor 35 is varied by actuation of the switches 50. Actuation of the switches 50 is accomplished by the placement of DC bias lines 55 through the ground plane 40. A cut in the ground plane is provided to minimize signal leakage. The two split ground sections of ground plane 40 are separated by a cut and reconnected through the use of a thin-wire bond 60.

Figure 3:
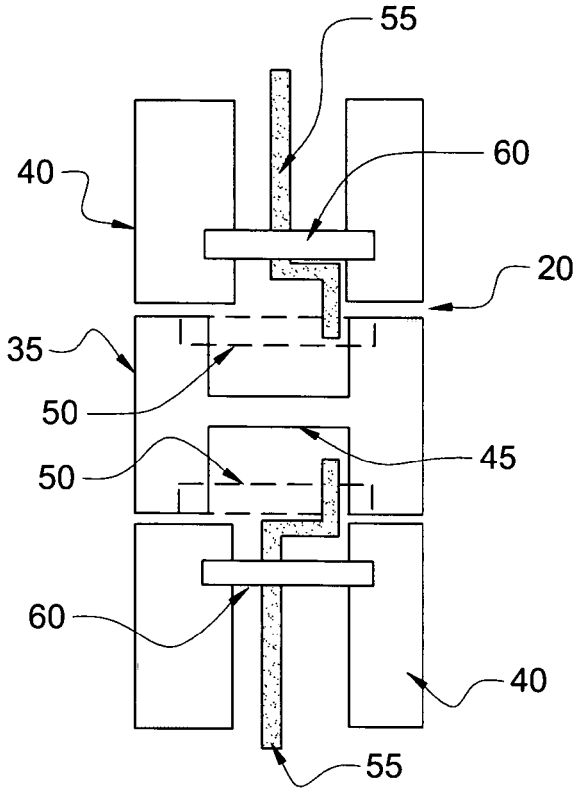
FIG. 3 is a diagrammatic view of an embodiment of the tunable radio frequency microelectromechanical inductor in accordance with the present invention illustrating a uniform narrow width inductive section of the center conductor.
Figure 4:
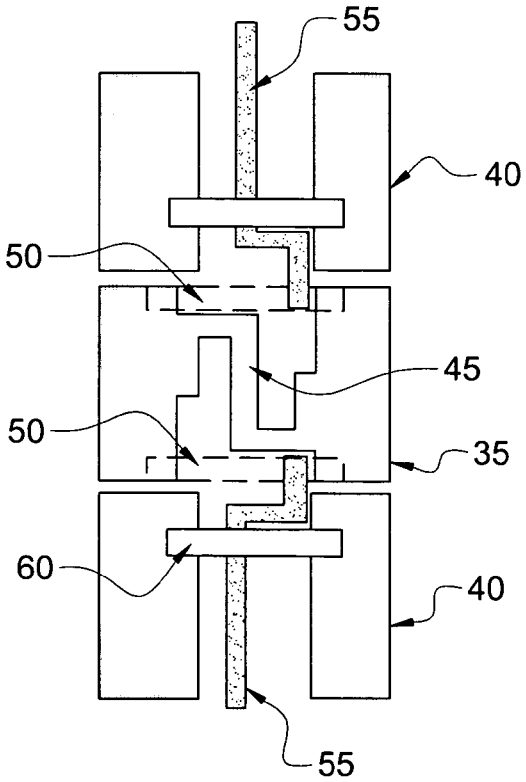
FIG. 4 is a diagrammatic view of an embodiment of the tunable radio frequency microelectromechanical inductor in accordance with the present invention illustrating a meandered narrow width inductive section of the center conductor.

FIG. 3 and FIG. 4 illustrate schematics of the tunable MEMS inductor. In FIG. 3, the narrow center conductor 45 is a uniform high impedance line. In FIG. 4, the inductance ratio is increased by using a meandered center conductor 45. In a particular embodiment, the overall length of the inductive section for both designs is approximately 600 μm and the width of the cantilever beams is approximately 50 μm.

In a particular embodiment, the distributed tunable inductor is designed to operate from 5-30 GHz using DC-contact MEMS switches on a 500 μm thick quartz substrate. A high inductance value is realized using a small length of high impedance line, while a low inductance is realized by reconfiguring the same circuit to yield a low impedance line using DC-contact switches. In a specific embodiment, cantilever beams 50 are used as series type DC-contact switches, suspended on 1.5 μm thick posts that are located on the center conductor 35. When the beams are in the non-actuated state, the signal is carried only on the thin center conductor 45 of the CPW line and a high value of characteristic impedance is obtained. Since the length of the narrow section is electrically small the topology effectively emulates an inductor with high inductance value. Similarly, when the beams make contact, the effective width of the center conductor 45 increases and the characteristic impedance with respect to the high impedance state is less; correspondingly, this represents a low inductance state. The inductance ratio is directly related to the change in the impedance states.

Figure 5:
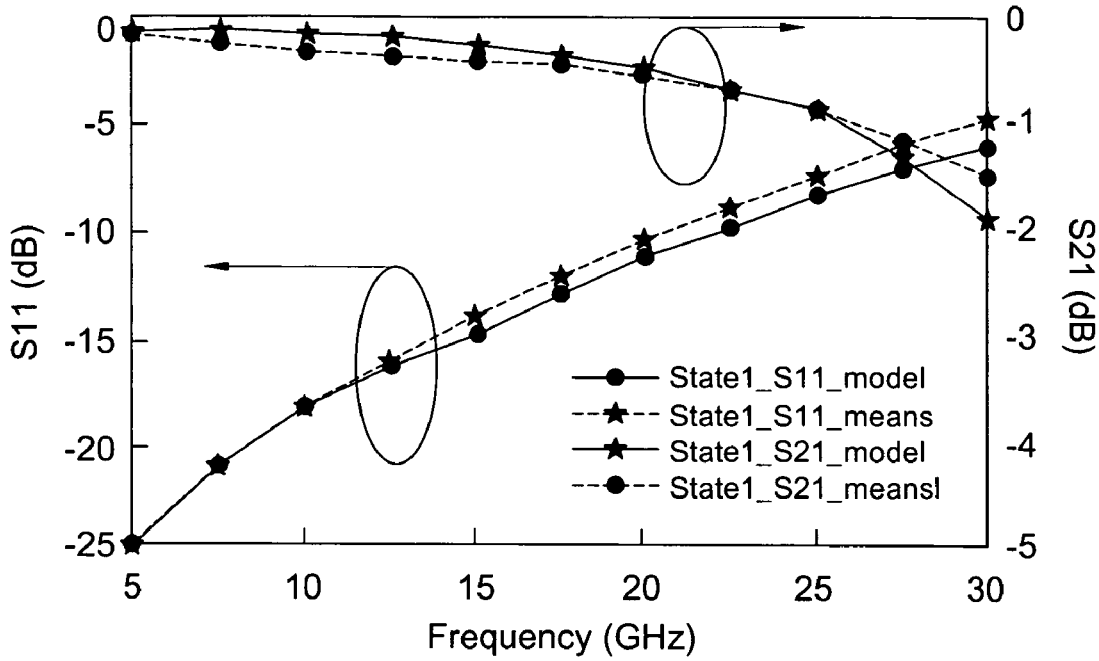
FIG. 5 is a graph illustrating the comparison between the measured and modeled data of the tunable inductor in accordance with the present invention when the DC-switches are in the non-actuated state.
Figure 6:
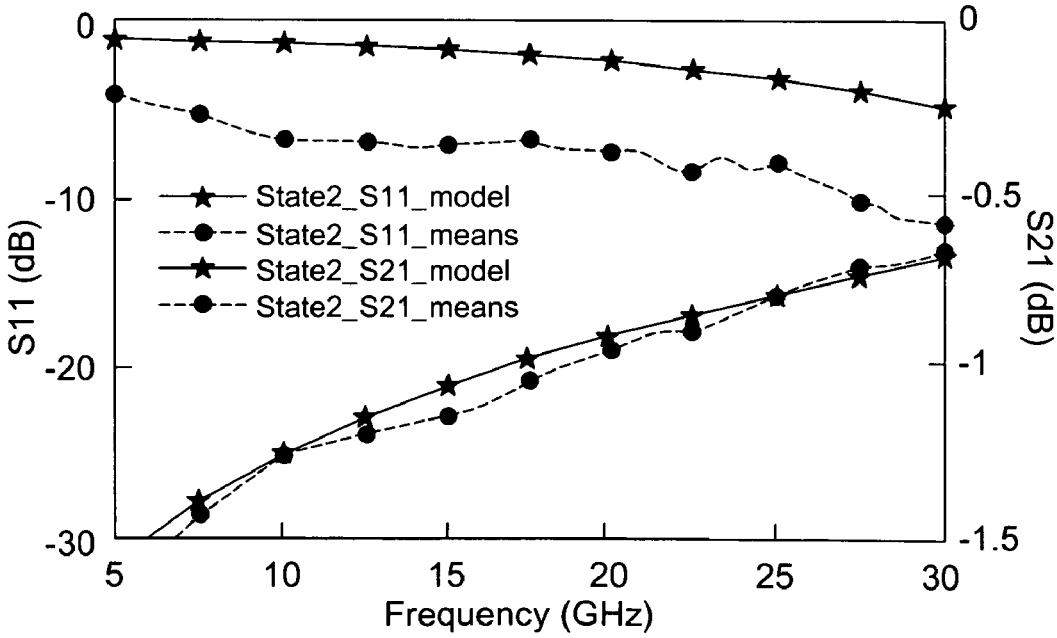
FIG. 6 is a graph illustrating the comparison between the measured and modeled data of the tunable inductor in accordance with the present invention when the DC-switches are in the actuated state.

FIG. 5 and FIG. 6 illustrate the measured and modeled $S_{11}$ and $S_{21}$ for the tunable inductor in two states. FIG. 5 illustrates a comparison between the measured and modeled data of the tunable inductor in state 1, in which the DC-switches are in the non-actuated state. Solid lines represent the modeled data and dotted lines represent the measured data. The modeled data pertains to full wave electromagnetic (EM) simulations. FIG. 6 illustrates a comparison between the measured and modeled data of the tunable inductor in state 2, in which the DC-switches are actuated. Again, solid lines represent the modeled data and dotted lines represent the measured data.

Figure 7:
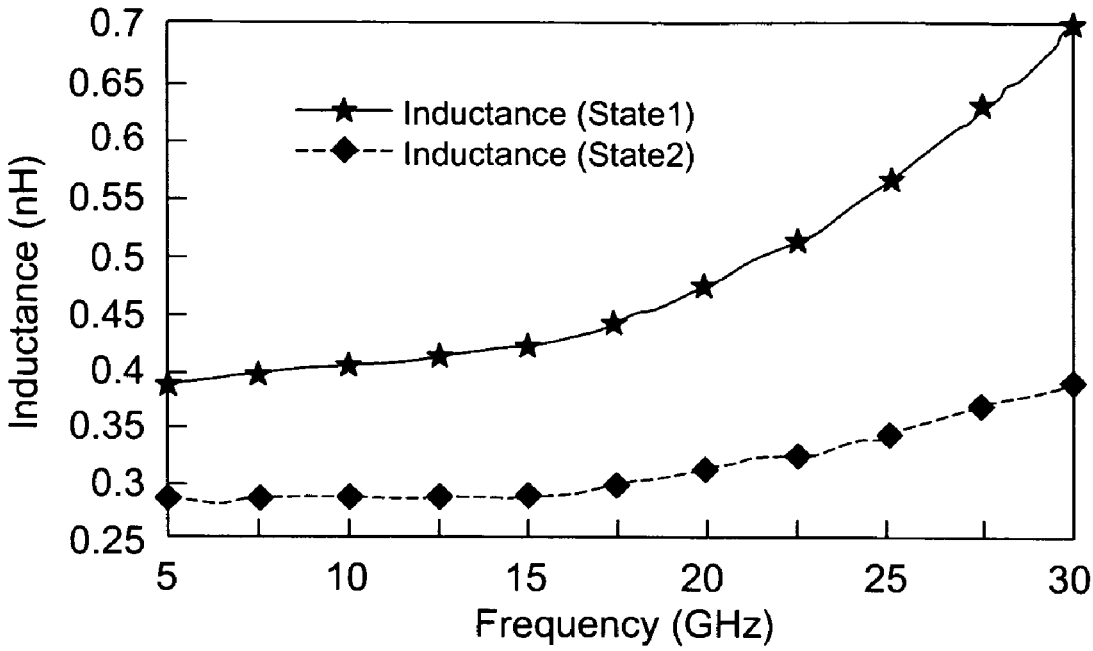
FIG. 7 is a graph illustrating the extracted inductance of the tunable inductor in accordance with the present invention in the non-actuated (state 1) and actuated states (state 2).

The extracted inductance versus frequency in both states (actuated and non-actuated) is shown in FIG. 7. It is seen from this figure that the inductance ratio (inductance in the high impedance state with respect to the inductance in the low impedance state) is approximately 1.8 at 30 GHz.

Accordingly, the present invention provides a planar MEMS tunable inductor utilizing series cantilever beams that are DC-contact type switches to vary the effective width of a CPW center conductor.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between. Now that the invention has been described,

What is claimed is:

1. A tunable radio frequency microelectromechanical inductor, the inductor comprising:

a coplanar waveguide having a center conductor and two spaced apart ground conductors, the center conductor positioned between the two spaced apart ground conductors, and the center conductor further comprising a narrow width inductive section;

at least one direct current actuatable contact switch positioned to vary the effective width of the narrow inductive section of the center conductor upon actuation of the at least one contact switch; and a direct current bias line positioned to actuate the at least one actuatable contact switch.

2. The tunable inductor of claim 1, wherein the inductive section of the center conductor is substantially straight and of uniform width over the length of the section.

3. The tunable inductor of claim 1, wherein the inductive section of the center conductor is a meandered center conductor over the length of the section.

4. The tunable inductor of claim 1, wherein the actuatable contact switch is in contact at one end with the center conductor and suspended above the coplanar waveguide bordering the narrow inductive section of the center conductor.

5. The tunable inductor of claim 1, wherein the actuatable contact switch is a cantilever beam.

6. The tunable inductor of claim 5, wherein the cantilever beam is positioned adjacent to and in contact with the center conductor at one end through a standoff post.

7. The tunable inductor of claim 5, wherein the cantilever beam has a width of approximately 50 μm.

8. The tunable inductor of claim 1, wherein the direct current bias line passes through a cut in the ground plane of the ground conductors and under the actuatable switch.

9. The tunable inductor of claim 1, wherein the direct current bias line is a SiCr line passing through a cut in the ground plane of the ground conductors and the ground planes split by the cut are electrically connected through a thin wire-bond.

10. The tunable inductor of claim 1, wherein the direct current bias line is a SiCr line passing through a cut in the ground plane of the ground conductors and the ground planes split by the cut are electrically connected through an air-bridge.

11. The tunable inductor of claim 1, wherein the at least one direct current actuatable contact switch further comprises a plurality of direct current actuatable contact switches.

12. The tunable inductor of claim 1, wherein the length of the narrow width inductive section of the center conductor is equal to approximately one fourth of an operating wavelength of the inductor.

13. The tunable inductor of claim 1, wherein the length of the inductive section is approximately 600 μm.

14. A method of tuning a radio frequency microelectromechanical inductor, the method comprising the steps of:

providing a coplanar waveguide having a center conductor and two spaced apart ground conductors, the center conductor positioned between the two spaced apart ground conductors, and the center conductor further comprising a narrow width inductive section; positioning at least one direct current actuatable contact switch to vary the effective width of the narrow inductive section of the center conductor upon actuation of the at least one contact switch; and positioning a direct current bias line to actuate the at least one actuatable contact switch.

15. A tunable radio frequency microelectromechanical inductor, the inductor comprising:

a coplanar waveguide having a center conductor and two spaced apart ground conductors, the center conductor positioned between the two spaced apart ground conductors, and the center conductor further comprising a narrow width inductive section;

two cantilever beams positioned on opposite sides of the narrow inductive width section and spanning the narrow width induction section, the cantilever beams positioned to vary the effective width of the narrow inductive section of the center conductor upon actuation of the two cantilever beams; and a direct current bias line positioned to actuate the two cantilever beams, the bias line passing through a cut in the ground plane of the ground conductors and the ground planes split by the cut being electrically connected through a thin wire-bond.

* * * * *